US007904989B1

(12) United States Patent
Chen

(10) Patent No.: US 7,904,989 B1
(45) Date of Patent: Mar. 15, 2011

(54) ROTARY ERASER ASSEMBLY

(75) Inventor: Tao-Chuan Chen, Taichung (TW)

(73) Assignee: Tsan Chung Industrial Co., Ltd., Taichung (TW)

( * ) Notice: Subject to any disclaimer, the term of this patent is extended or adjusted under 35 U.S.C. 154(b) by 469 days.

(21) Appl. No.: 12/025,018

(22) Filed: Feb. 2, 2008

(51) Int. Cl.
*B24D 13/02* (2006.01)

(52) U.S. Cl. ..... 15/230.16; 15/179; 15/230; 15/230.17; 15/230.19; 451/358; 451/527; 451/530; 451/542; 451/547

(58) Field of Classification Search ..... 15/3.53, 15/230, 230.14, 230.16–230.19, 179, 181; 451/358, 542, 547, 527, 530, 294, 295
See application file for complete search history.

(56) References Cited

U.S. PATENT DOCUMENTS

| | | | | | |
|---|---|---|---|---|---|
| 1,281,777 | A | * | 10/1918 | Hardy | 464/184 |
| 1,908,399 | A | * | 5/1933 | Boland et al. | 15/230.19 |
| 2,384,599 | A | * | 9/1945 | Case | 15/230.16 |
| 6,716,095 | B1 | * | 4/2004 | Hsu et al. | 451/358 |

FOREIGN PATENT DOCUMENTS

| | | |
|---|---|---|
| GB | 2345014 | * 6/2000 |
| WO | 88/09707 | * 12/1988 |

* cited by examiner

*Primary Examiner* — Mark Spisich

(57) ABSTRACT

A rotary eraser assembly includes a rotary eraser, two discs, a threaded bolt and a nut. The rotary eraser includes, in each of two opposite sides, a cavity in communication with the aperture and at least one recess in the wall of the cavity. Each of the discs includes an annular lip disposed in the cavity in a related one of the sides of the rotary eraser and at least one block disposed in the recess in the related side of the rotary eraser. The threaded bolt is inserted through the rotary eraser and the discs. The nut is engaged with threaded bolt.

5 Claims, 5 Drawing Sheets

ROTARY ERASER ASSEMBLY

BACKGROUND OF INVENTION

1. Field of Invention

The present invention relates to a rotary eraser assembly for erasing residue of glue.

2. Related Prior Art

Glue is often used to attach various decorations to various things such as the doors of vehicles. Glue is used to attach sunshades to the windows of vehicles. The glue ensures the firm attachment of the decorations or sunshades to the doors or windows. Sometimes, a decoration or sunshade is peeled from a door or window. Sometimes, it is intended to replace a decoration or sunshade with a new one. In these cases, there is residue of glue on the door or window.

Chemicals can be used to clean the door or window of the residue of glue. It is however difficult. Worse, the chemicals might damage the door or window.

There are various rotary eraser assemblies for erasing the residue of glue from the door or window. Such a rotary eraser assembly includes an axle, a rotary eraser provided on the axle, two discs provided on the axle so that the rotary eraser is located between the discs and tabs for fastening the rotary eraser to the discs.

As disclosed in Taiwanese Patent M272624, a rotary eraser assembly includes two discs 20 and a rotary eraser 10 provided around the discs 20 by injection molding. That is, the discs 20 are embedded in the rotary eraser 10. The discs will not be broken when they are subjected to a huge torque needed for driving the rotary eraser 10. The discs 20 however have to be disposed of together with the rotary eraser 10 when only the later is consumed and has to be replaced with a new one. This is a waste.

As disclosed in Taiwanese Patent M291870, a rotary eraser assembly includes a rotary eraser 16 and two discs 14 and 15. The rotary eraser 16 is sandwiched between the discs 14 and 15 and formed with slots 18 for receiving tabs extended from the discs 14 and 15. The tabs could however be broken when they are subjected to a huge torque needed for driving the rotary eraser 16.

As disclosed in Taiwanese Patent Publication No. 364416, a rotary eraser assembly includes a rotary eraser 16 and two discs 14 and 15. The rotary eraser 16 is sandwiched between the discs 14 and 15 and formed with slots 18 for receiving tabs extended from the discs 14 and 15. The tabs could however be broken when they are subjected to a huge torque needed for driving the rotary eraser 16.

As disclosed in Taiwanese Patent Publication No. 399506, a rotary eraser assembly includes a rotary eraser 22 and two discs 14 and 19. The rotary eraser 22 is sandwiched between the discs 14 and 19. The disc 14 is formed with three tabs 15 connected to one another. The rotary eraser 22 includes three slots 23 for receiving the tabs 15. The tabs 15 could however be broken when they are subjected to a huge torque needed for driving the rotary eraser 22.

The present invention is therefore intended to obviate or at least alleviate the problems encountered in prior art.

SUMMARY OF INVENTION

It is the primary objective of the present invention to provide a reliable rotary eraser assembly.

To achieve the primary objective of the present invention, a rotary eraser assembly includes a rotary eraser, two discs, a threaded bolt and a nut. The rotary eraser includes, in each of two opposite sides, a cavity in communication with the aperture and at least one recess in the wall of the cavity. Each of the discs includes an annular lip disposed in the cavity in a related one of the sides of the rotary eraser and at least one block disposed in the recess in the related side of the rotary eraser. The threaded bolt is inserted through the rotary eraser and the discs. The nut is engaged with threaded bolt.

Other objectives, advantages and features of the present invention will become apparent from the following description referring to the attached drawings.

BRIEF DESCRIPTION OF DRAWINGS

The present invention will be described via the detailed illustration of three embodiments referring to the drawings.

DETAILED DESCRIPTION OF PREFERRED EMBODIMENT

Figure 1:
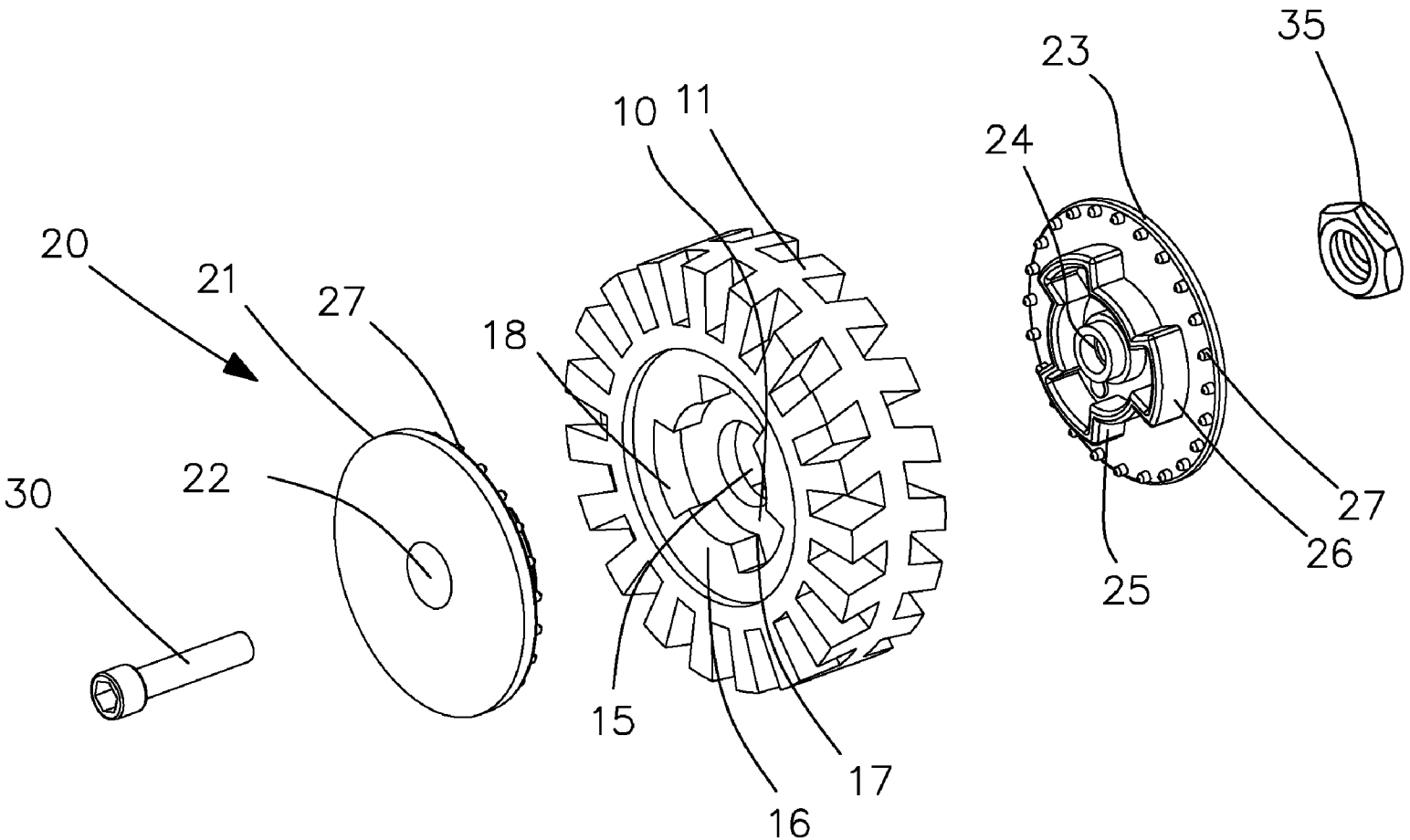
FIG. 1 is an exploded view of a rotary eraser assembly according to the first embodiment of the present invention.
Figure 2:
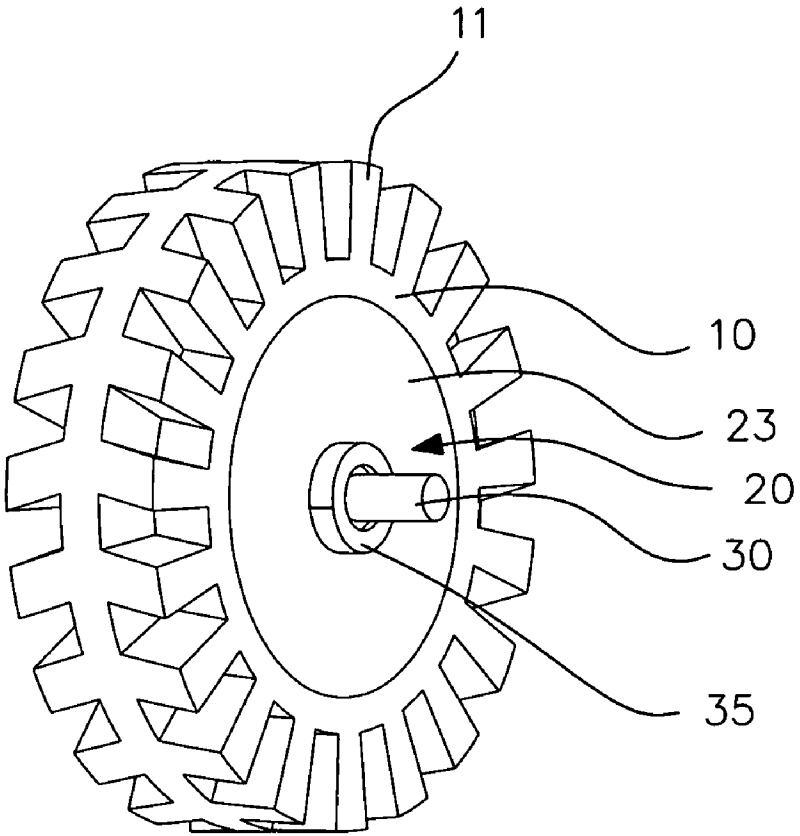
FIG. 2 is a perspective view of the rotary eraser assembly shown in FIG. 1.

Referring to FIGS. 1 through 4, a rotary eraser assembly includes a rotary eraser 10, a disc pair 20 for sandwiching the rotary eraser 10, a threaded bolt 30 inserted through the rotary eraser 10 and the disc pair 20 and a nut 35 engaged with the threaded bolt 30 according to the preferred embodiment of the present invention. The disc pair 20 includes a first disc 21 and a second disc 23.

The rotary eraser 10 is in the form of a wheel. The rotary eraser 10 includes erasing fins 11 on the periphery and an aperture 15 centrally defined therein. The rotary eraser 10 includes two opposite sides each including a shallow cavity 16 therein, a deep cavity 17 between the aperture 15 and the shallow cavity 16 and recesses 18 in the wall of the deep cavity 17.

The first disc 21 includes a hub 22 on a side, an annular lip 25 around the hub 22, blocks 26 extended from the annular lip 25 in a radial manner and bosses 27 around the annular lip 25. The hub 22 includes a countersink hole therein.

The second disc 23 includes a hub 24 on a side, an annular lip 25 around the hub 24, blocks 26 extended from the annular lip 25 in a radial manner and bosses 27 around the annular lip 25. The hub 24 includes an aperture therein.

Figure 3:
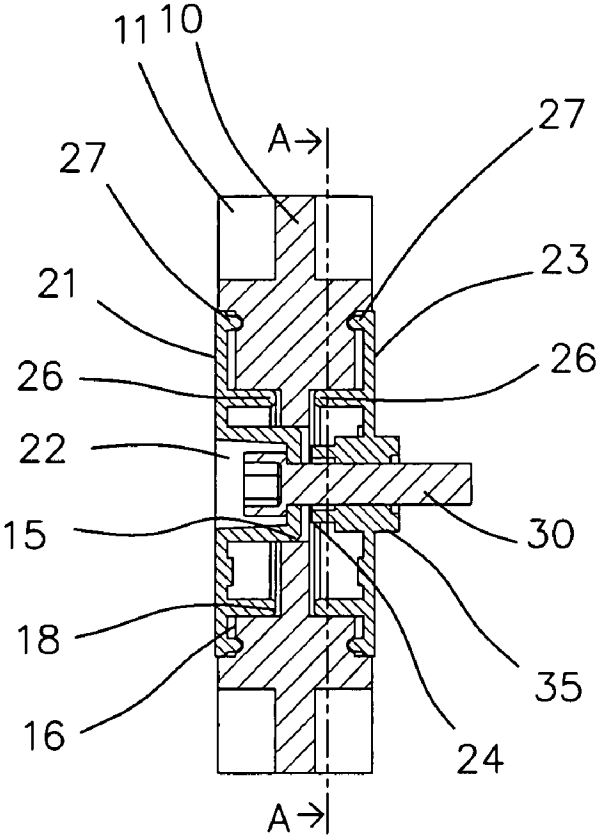
FIG. 3 is a cross-sectional view of the rotary eraser assembly shown in FIG. 2.

Referring to FIG. 3, the first disc 21 is disposed in the shallow cavity 16 in one of the sides of the rotary eraser 10, the annular lip 25 thereof is disposed in the deep cavity 17, the blocks 26 thereof are disposed in the recesses 18 and the hub 22 thereof is inserted in the aperture 15.

Figure 4:
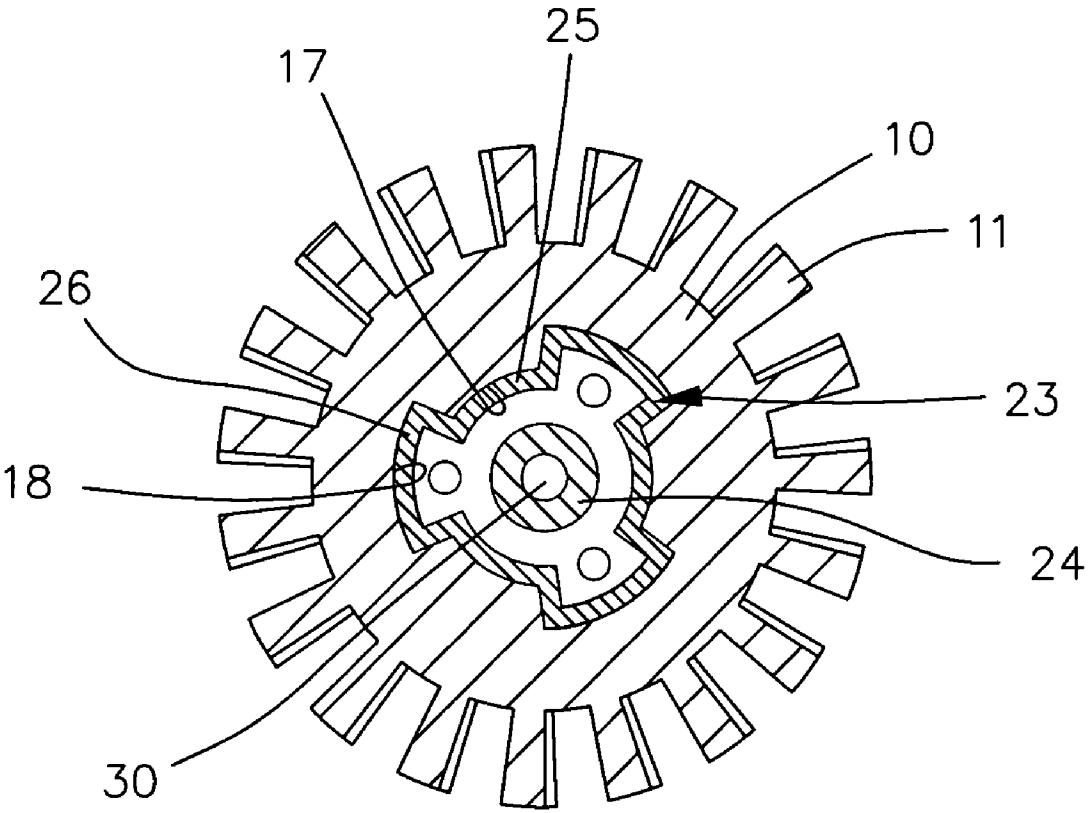
FIG. 4 is a cross-sectional view of the rotary eraser assembly taken along a line A-A shown in FIG. 3.

Referring to FIGS. 3 and 4, the second disc 23 is disposed in the shallow cavity 16 in the other side of the rotary eraser 10, the annular lip 25 thereof is disposed in the deep cavity 17 and the blocks 26 thereof are disposed in the recesses 18.

The threaded bolt 30 is inserted through the first disc 21, the rotary eraser 10 and the second disc 23. The threaded bolt 30 is engaged with the nut 35. The threaded bolt 30 is formed with an enlarged head disposed in the countersink hole of the hub 22 of the first disc 21. The nut 35 is abutted against the second disc 23. Thus, the bosses 27 of the first disc 21 are forced into one of the sides of the rotary eraser 10 while the bosses 27 of the second disc 23 are forced into the other side of the rotary eraser 10. Therefore, the rotary eraser 10 is firmly sandwiched between the first disc 21 and the second disc 23.

Figure 5:
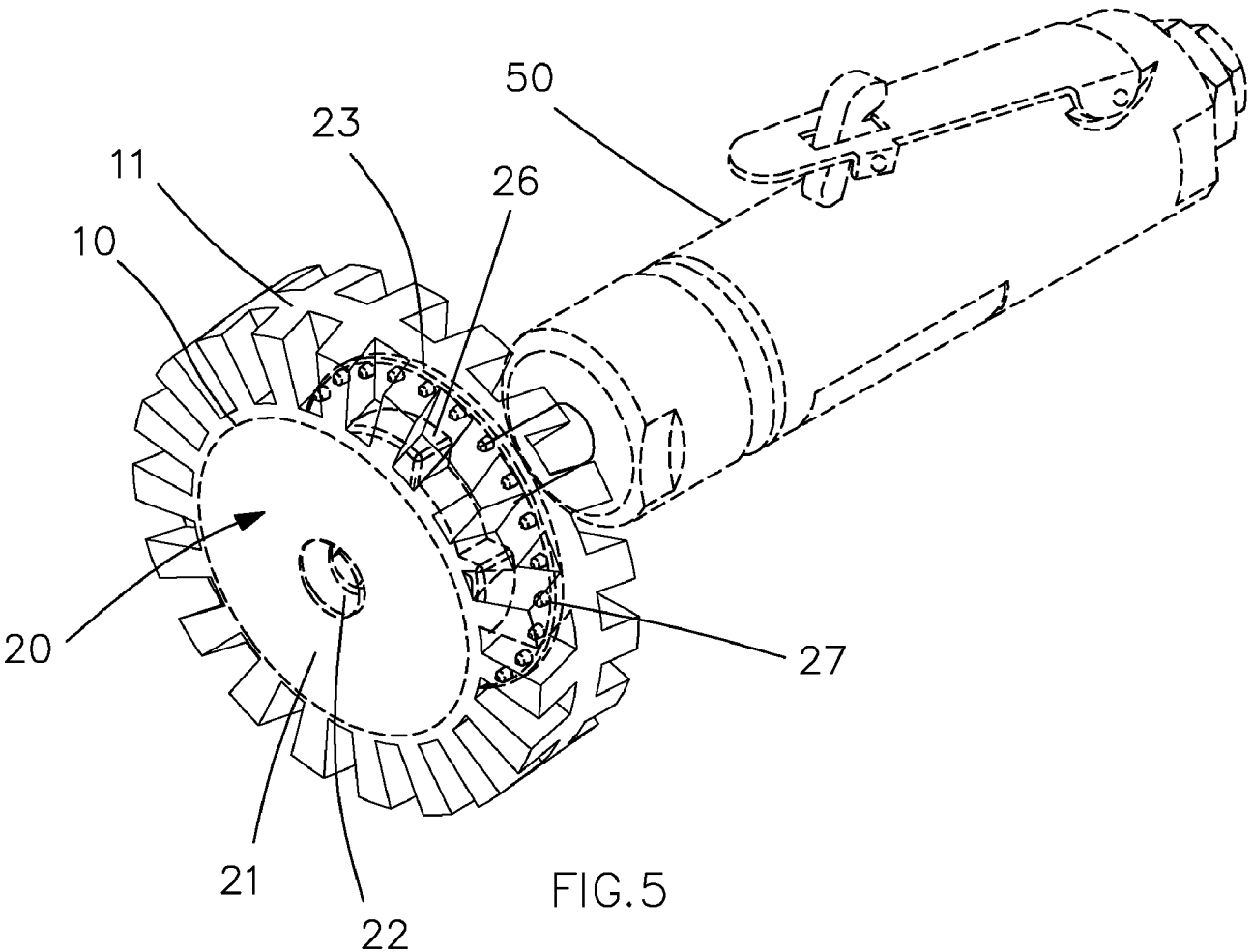
FIG. 5 is a perspective view of a driving device operatively connected to the rotary eraser assembly shown in FIG. 2.

Referring to FIG. 5, the rotary eraser assembly is operatively connected to a driving device 50. The driving device 50 can rotate the rotary eraser assembly to erase residue of glue from an object.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A rotary eraser assembly comprising:

a rotary eraser comprising, in each of two opposite sides, a cavity in communication with an aperture centrally defined therein and at least one recess in the wall of the cavity;

two discs each comprising an annular lip disposed in the cavity in a related one of the sides of the rotary eraser, at least one block disposed in the recess in the related side of the rotary eraser and bosses formed thereon;

a threaded bolt inserted through the rotary eraser and the discs; and a nut engaged with the threaded bolt so that the bosses of each of the discs are forced into a related one of the sides of the rotary eraser.

2. The rotary eraser assembly according to claim 1, wherein the rotary eraser comprises, in each of the sides, a shallow cavity for receiving a related one of the discs.

3. The rotary eraser assembly according to claim 1, wherein the rotary eraser comprises erasing fins on the periphery.

4. The rotary eraser assembly according to claim 1, wherein one of the discs comprises a hub disposed in the aperture.

5. The rotary eraser assembly according to claim 4, wherein the hub receives a head of the threaded bolt.

* * * * *